US010214943B2

(12) United States Patent
Kovie

(10) Patent No.: US 10,214,943 B2
(45) **Date of Patent: *Feb. 26, 2019**

(54) VEHICLE DOOR LATCH MECHANISM

(71) Applicant: Nissan North America, Inc., Franklin, TN (US)

(72) Inventor: David A Kovie, Livonia, MI (US)

(73) Assignee: Nissan North America, Inc., Franklin, TN (US)

( * ) Notice: Subject to any disclaimer, the term of this patent is extended or adjusted under 35 U.S.C. 154(b) by 321 days.

This patent is subject to a terminal disclaimer.

(21) Appl. No.: 15/086,658

(22) Filed: Mar. 31, 2016

(65) Prior Publication Data

US 2016/0215529 A1 Jul. 28, 2016

Related U.S. Application Data

(63) Continuation of application No. 13/481,580, filed on May 25, 2012, now Pat. No. 9,322,198.

(51) Int. Cl.

| | |
|---|---|
| ***E05B 77/06*** | (2014.01) |
| ***E05B 79/10*** | (2014.01) |
| ***E05B 85/24*** | (2014.01) |
| *E05B 79/22* | (2014.01) |

(52) U.S. Cl.

CPC ..... *E05B 77/06* (2013.01); *E05B 79/10* (2013.01); *E05B 85/243* (2013.01); *E05B 79/22* (2013.01)

(58) Field of Classification Search

CPC ..... E05B 77/06; E05B 79/10; E05B 85/243; E05B 79/22

USPC ..... 292/201, 216, DIG. 23, DIG. 22

See application file for complete search history.

(56) References Cited

U.S. PATENT DOCUMENTS

| | | | |
|---|---|---|---|
| 3,104,124 | A | 9/1963 | Reck |
| 3,799,596 | A | 3/1974 | Nozomu et al. |
| 5,769,471 | A | 6/1998 | Suzuki et al. |
| 7,198,307 | B2 | 4/2007 | Drysdale et al. |
| 7,201,405 | B2 | 4/2007 | Le et al. |
| 7,210,714 | B2 | 5/2007 | Berghahn et al. |
| 7,210,716 | B2 | 5/2007 | Mueller et al. |
| 7,287,785 | B2 | 10/2007 | Schupp et al. |

(Continued)

FOREIGN PATENT DOCUMENTS

| | | | |
|---|---|---|---|
| JP | 2005-240546 | A | 9/2005 |
| WO | 2009-123802 | A1 | 10/2009 |

*Primary Examiner* — Kristina R Fulton
*Assistant Examiner* — Thomas L Neubauer
(74) *Attorney, Agent, or Firm* — Global IP Counselors, LLP

(57) ABSTRACT

A latch assembly includes a housing, a door latch member and a release member. The door latch member pivots about a first pivot axis. The release member pivots about a second pivot axis spaced apart from the first pivot axis located within the housing operatively coupled to the latch retaining member. An inertia activated lock-out mechanism is fixedly attached to the housing and includes a locking member within the housing that pivots about a third pivot axis spaced apart from the first and second pivot axes. The first, second and third pivot axes are all parallel to one another at fixed locations within the housing. The locking member pivots between a locking position preventing movement of the release member and a non-interfering position in which the locking member is spaced apart from the release member allowing the release member to be movable.

14 Claims, 10 Drawing Sheets

(56) References Cited

U.S. PATENT DOCUMENTS

| | | | | |
|---|---|---|---|---|
| 7,607,702 | B2 | 10/2009 | Pereverzev | |
| 7,635,151 | B2 | 12/2009 | Rodawold, Jr. et al. | |
| 7,726,707 | B2 | 6/2010 | Simchayoff et al. | |
| 8,056,944 | B2 | 11/2011 | Jankowski et al. | |
| 8,141,038 | B2 | 3/2012 | O'Connell et al. | |
| 8,152,209 | B2 | 4/2012 | Lee | |
| 8,408,612 | B2 | 4/2013 | Jankowski et al. | |
| 8,414,038 | B2 * | 4/2013 | Bedekar ..... | E05B 77/04 292/216 |
| 2005/0184537 | A1 | 8/2005 | Le et al. | |
| 2009/0064591 | A1 | 3/2009 | Keller et al. | |
| 2009/0243307 | A1 | 10/2009 | Lee | |
| 2010/0026014 | A1 | 2/2010 | Machida et al. | |
| 2012/0036785 | A1 | 2/2012 | Bedekar et al. | |

* cited by examiner

VEHICLE DOOR LATCH MECHANISM

CROSS-REFERENCE TO RELATED APPLICATIONS

This application is a continuation application of U.S. patent application Ser. No. 13/481,580 filed on May 25, 2012. The entire disclosure of U.S. patent application Ser. No. 13/481,580 is hereby incorporated herein by reference.

BACKGROUND

Field of the Invention

The present invention generally relates to a vehicle door latch mechanism. More specifically, the present invention relates to a vehicle door latch mechanism that includes an inertia activated lock-out mechanism that is located on the door latch mechanism that prevents movement of the vehicle door latch mechanism from a latched position in response to an impact event.

Background Information

The door of a vehicle typically includes a handle release mechanism that is connected via cable or other mechanical linkage to a door latch mechanism. The door latch mechanism is configured to keep the door of the vehicle in a closed orientation until a passenger operates the handle release mechanism to release the door latch mechanism allowing the door of the vehicle to move to an open orientation. In recent years, handle release mechanisms have included features that prevent the handle release mechanism from operating the door latch mechanism during an impact event.

SUMMARY

One object of the invention is to provide an inertia activated lock-out mechanism directly to or on a latch mechanism for a vehicle door configured to prevent the latch mechanism from opening a door in response to inertia.

In accordance with one aspect, a vehicle door latch mechanism includes a latch assembly and an inertial activated lock-out mechanism. The latch assembly includes a housing, a door latch member, a latch retaining member and a release member. The door latch member is movably supported within the housing to pivot about a first pivot axis between a latched position and an unlatched position. The latch retaining member is movably supported within the housing to pivot between a retaining position retaining the door latch member in the latched position and a releasing position. The release member is supported within the housing for pivotal movement about a second pivot axis spaced apart from the first pivot axis. The release member has a first end connected to a cable of a remote actuation part and a second end located within the housing operatively coupled to the latch retaining member. The release member moves in response to movement of the cable. The inertia activated lock-out mechanism includes a locking member disposed within the housing and is pivotally supported by the housing for movement about a third pivot axis spaced apart from the first pivot axis and the second pivot axis. The first pivot axis, the second pivot axis and the third pivot axis are all parallel to one another at fixed locations within the housing. The locking member pivots between a locking position in which the locking member contacts the release member to prevent movement of the release member independent of movement of the cable of the remote actuation part and a non-interfering position in which the locking member is spaced apart from the release member allowing the release member to be movable. The inertia activated lock-out mechanism further includes a counterweight operatively coupled to the locking member to move the locking member to the locking position in response to an inertial force exceeding a threshold level.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
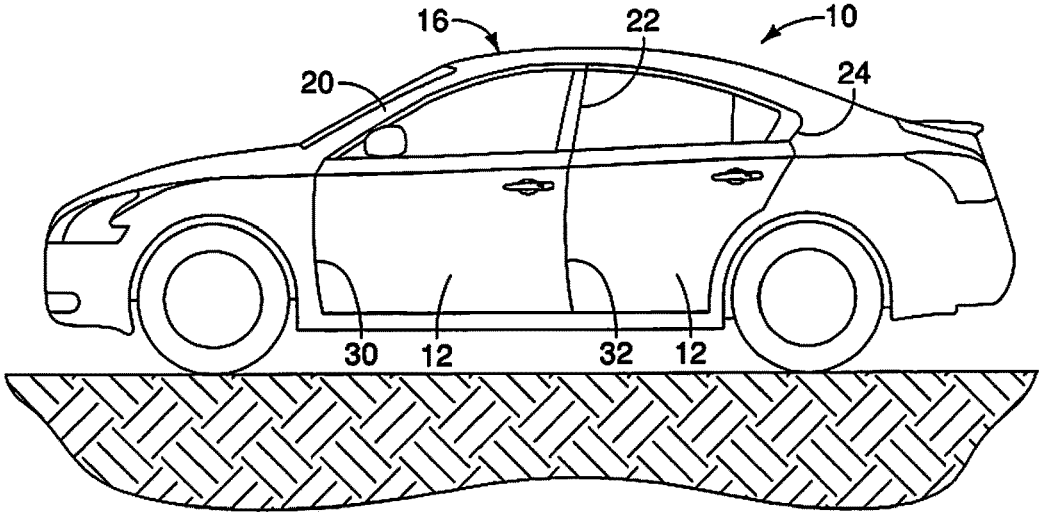
FIG. 1 is a side view of a vehicle that includes a door with a door latch mechanism that includes an inertia activated lock-out mechanism in accordance with a first embodiment.
Figure 2:
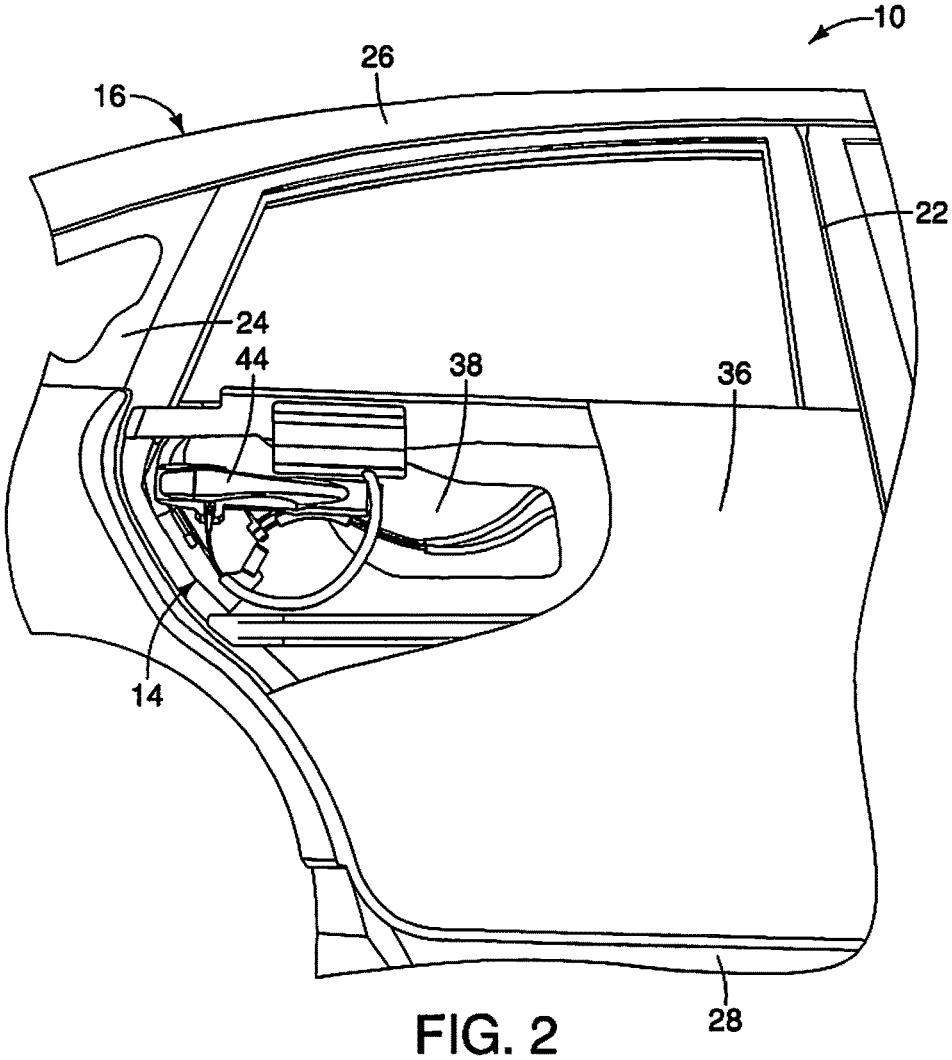
FIG. 2 is a side view of the door of the vehicle showing a portion of the latch mechanism in accordance with the first embodiment.

Referring initially to FIGS. 1 and 2, a vehicle 10 is illustrated that includes a vehicle door 12 with a door latch mechanism 14 (FIG. 2) in accordance with a first embodiment.

The vehicle 10 includes, among other things, a vehicle body 16 and the vehicle door 12. The vehicle body 16 includes many features and elements, but for the purposes of understanding the invention, only those features related to the vehicle door 12 and the door latch mechanism 14 are described below, for the sake of brevity. For instance, the side of the vehicle body 16 depicted in FIGS. 1 and 2, includes an A-pillar 20, a B-pillar 22, a C-pillar 24, a roof rail 26 and a sill 28. The A-pillar 20, the B-pillar 22, the roof rail 26 and the sill 28 define a front door opening 30. Similarly, the B-pillar 22, the C-pillar 24, the roof rail 26 and the sill 28 define a rear door opening 32.

The vehicle body 16 is assembled with, for example, a plurality of pre-shaped, molded or stamped sheet metal elements that are welded or otherwise fixedly attached to one another to define the structural features, such as, the A-pillar 20, the B-pillar 22, the C-pillar 24, the roof rail 26 and the sill 28. These structural features are conventional and therefore, further description is omitted for the sake of brevity.

Figure 4:
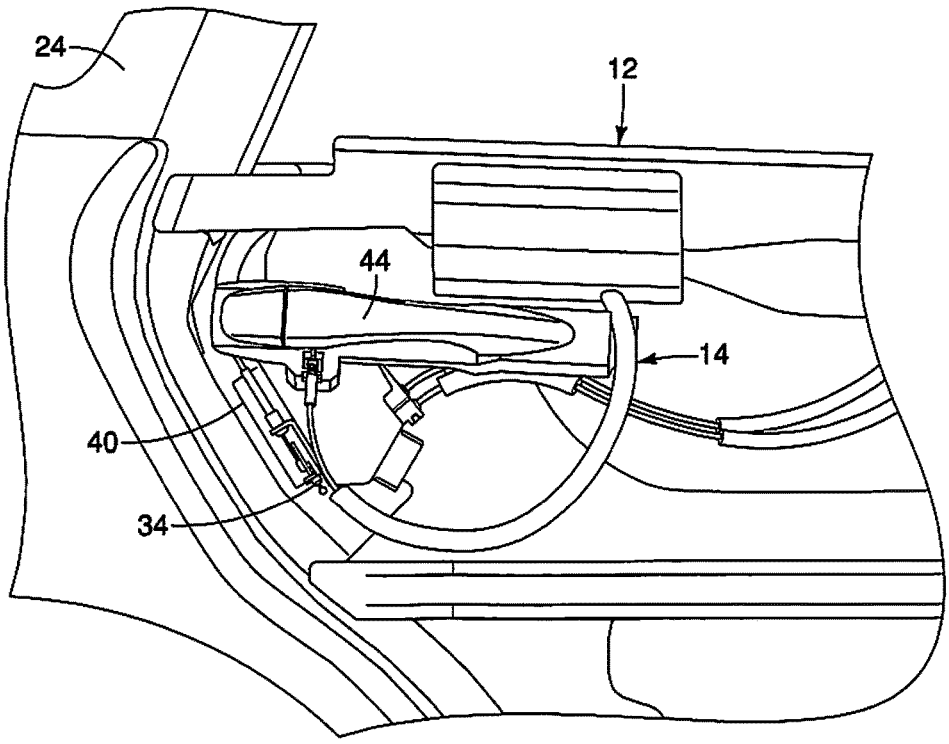
FIG. 4 is a cutaway side view of a portion of the door showing the latch mechanism in accordance with the first embodiment.

In the embodiment depicted in FIGS. 2 and 4, the door latch mechanism 14 is shown as being part of the vehicle door 12, which is a rear door. However, the vehicle door 12 (and the corresponding door latch mechanism 14) can also serve as the front door of the vehicle 10. In other words, the door latch mechanism 14 can be installed in either a front door or a rear door, or essentially any door with a latch and corresponding latch release mechanism. For the sake of brevity, description is provided for the vehicle door 12 being the rear door of the vehicle 10, but equally applies to a vehicle front door, a sliding door, a French style door (with hinges at a rearward portion of the door) and/or clam shell doors, such as those used in vans or commercial vehicles.

The vehicle door 12 is pivotally supported on the B-pillar 22 of the vehicle body 16 of the vehicle 10 between a closed (latched) position and an open (unlatched) position in a conventional manner. Specifically, the vehicle door 12 is pivotally attached at its forward end to the B-pillar 22 of the vehicle body 16 by a pair of hinges (not shown). The rearward end of the vehicle door 12 includes parts of the door latch mechanism 14 for latching the vehicle door 12 to the C-pillar 24 of the vehicle body 16 in a releasable manner.

As explained in greater detail below, the door latch mechanism 14 is provided with an inertia activated lock-out mechanism 34 (FIG. 3) for preventing the vehicle door 12 from inadvertently moving from the closed (latched) position to the open (unlatched) position in response to an impact event. Basically, as explained below, the inertia activated lock-out mechanism 34 is designed to respond to rapid changes in inertia during an impact event to prevent the vehicle door 12 from inadvertently unlatching from the C-pillar 24 of the vehicle body 16.

Since the focus of the present disclosure is directed to the vehicle door latch mechanism 14, the vehicle 10 and the vehicle door 12 will not be discussed in great detail or illustrated herein, except as they relate to the vehicle door latch mechanism 14.

As best seen in FIG. 2, the vehicle door 12 basically includes an outer door panel 36, an inner door panel 38 and the door latch mechanism 14. These components of the vehicle door 12 also constitute part of the vehicle door latch mechanism 14 of the illustrated embodiment, as described further below. The outer and inner door panels 36 and 38 are typically sheet metal members that are stamped and fixedly secured together by a suitable fastening technique such as welding, adhesive, fasteners, etc. Basically, the outer and inner door panels 36 and 38 define the hollow interior for housing the door latch mechanism 14 as well as other various door elements and/or mechanisms that are well known in the art.

Figure 3:
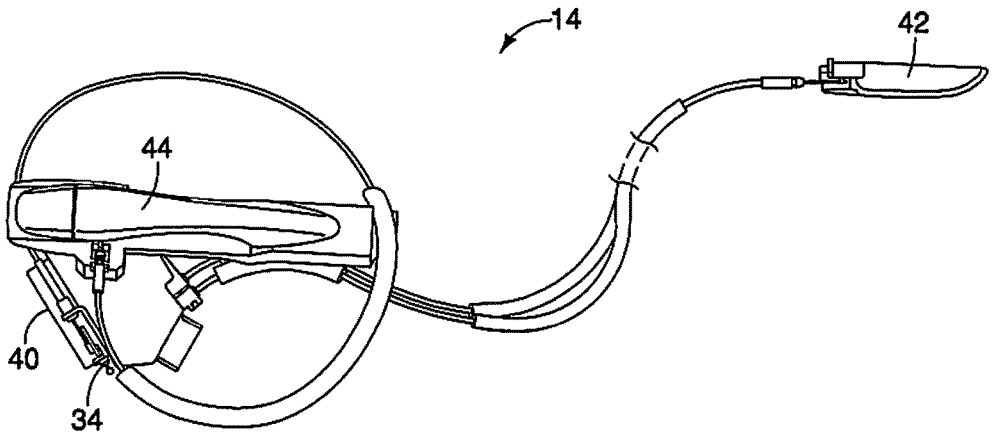
FIG. 3 is a side view of the latch mechanism shown removed from the door in accordance with the first embodiment.
Figure 5:
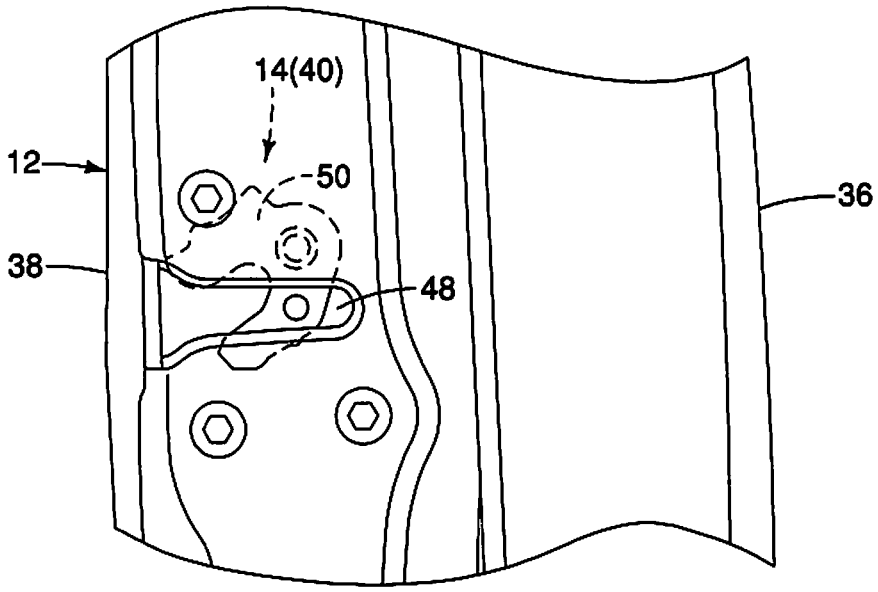
FIG. 5 is an end view of the door showing a latch member of the latch mechanism in accordance with the first embodiment.

As shown in FIG. 3, the door latch mechanism 14 basically includes a latch assembly 40, an inside door release handle 42, an outside door release handle 44, a striker 46 (shown in FIG. 6), and the inertia activated lock-out mechanism 34. The latch assembly 40 of the door latch mechanism 14 is bolted in position within the vehicle door 12 along a rear section of the vehicle door 12, as indicated in FIG. 5. The door latch mechanism 14 is operated by the inside door release handle 42 and the outside door release handle 44 in a conventional manner.

The inside door release handle 42 is fixedly attached to the inner door panel 38 in a conventional manner, such as removable fasteners or the like. Similarly, the outside door release handle 44 is fixedly attached to the outer door panel 36 in a conventional manner, such as removable fasteners or the like. The inside door release handle 42 and the outside door release handle 44 are conventional components and therefore further description is omitted for the sake of brevity, since their respective structures and operation are well known in the art.

Figure 6:
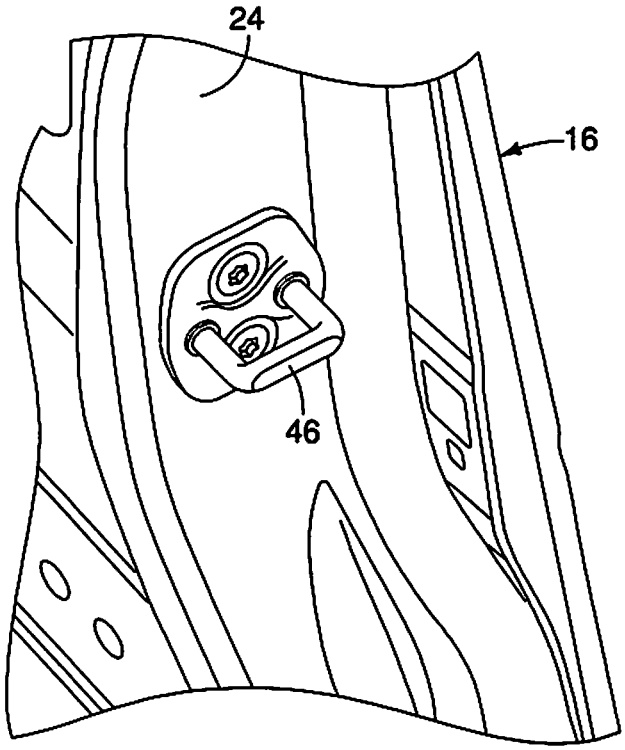
FIG. 6 is a perspective view of a pillar of the vehicle showing a striker that is engaged by the latch member of the latch mechanism when the door is in a closed position in accordance with the first embodiment.

As shown in FIG. 6, the striker 46 is bolted to the C-pillar 24 in a conventional manner.

Figure 8:
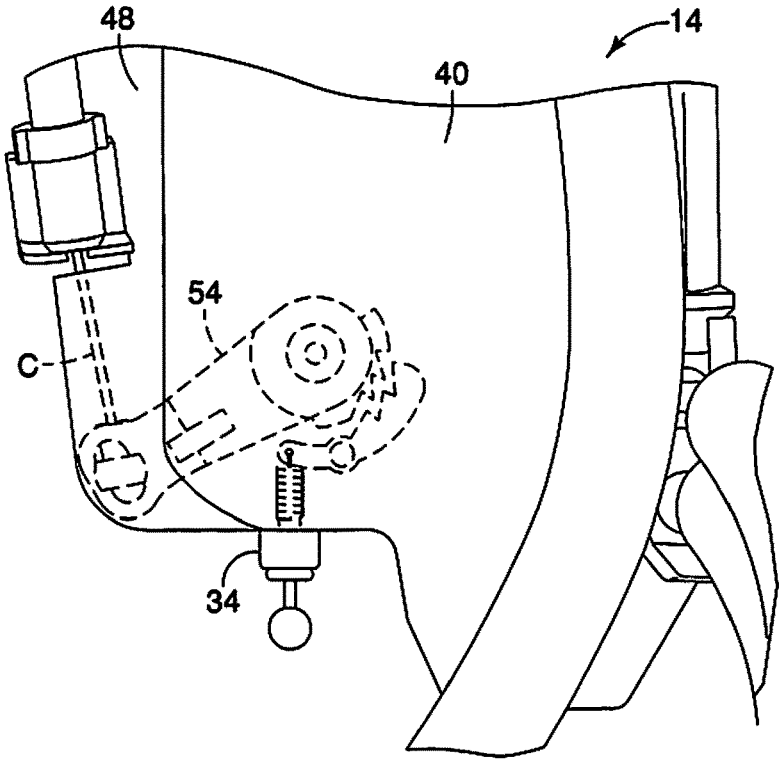
FIG. 8 is a side view of the latch mechanism showing elements of the inertia activated lock-out mechanism in phantom in accordance with the first embodiment.
Figure 9:
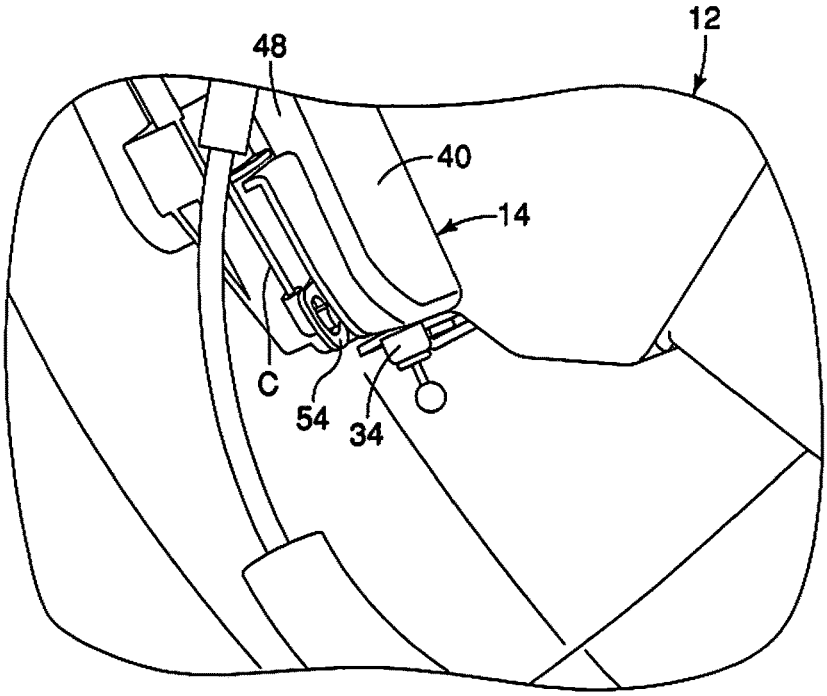
FIG. 9 is another perspective view showing a lower portion of the latch mechanism and elements of the inertia activated lock-out mechanism in accordance with the first embodiment.
Figure 10:
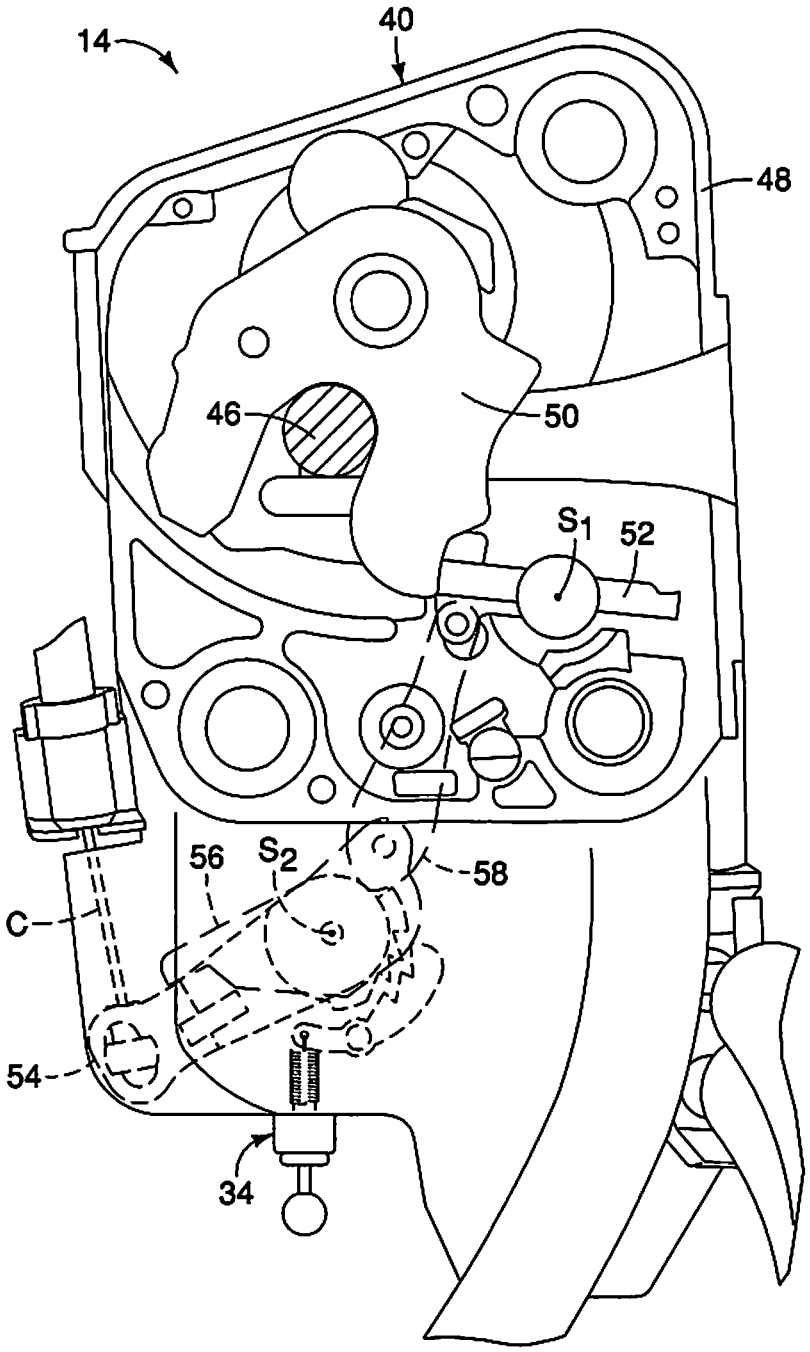
FIG. 10 is a front view of the latch mechanism showing the latch member and the inertia activated lock-out mechanism with the latch member in a latched position in accordance with the first embodiment.
Figure 11:
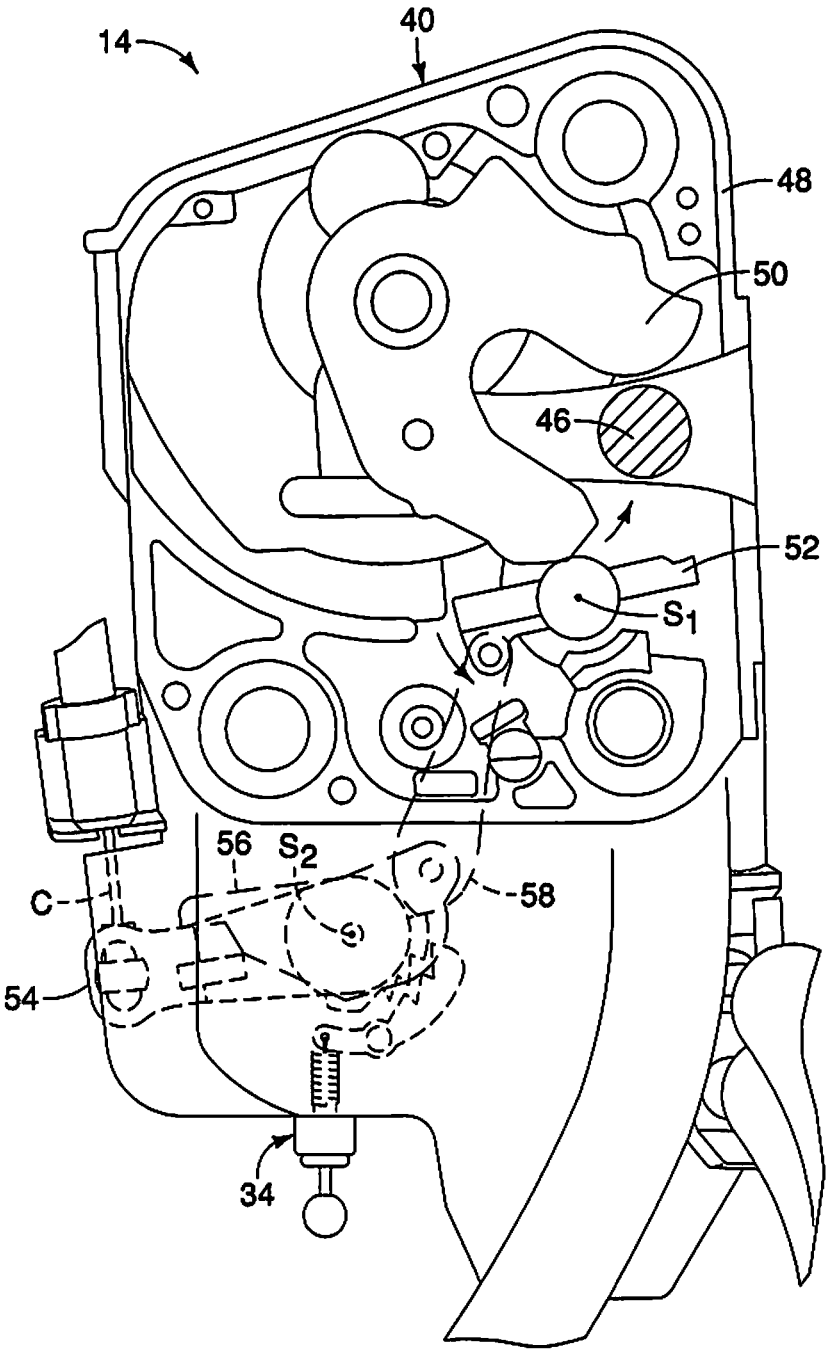
FIG. 11 is another front view of the latch mechanism showing the latch member and the inertia activated lock-out mechanism with the latch member in an unlatched position in accordance with the first embodiment.

As shown in FIGS. 8-11, the latch assembly 40 includes a plurality of elements, such as, for example, a housing 48, a door latch member 50 (FIGS. 5, 10 and 11), a latch retaining member 52 (FIGS. 10 and 11), a release member 54, a slave member 56 (FIGS. 10 and 11), and a link 58 (FIGS. 10 and 11).

The housing 48 is bolted to one or both of the outer and inner door panels 36 and 38, as indicated in FIG. 5. Hence, the housing 48, the outer and inner door panels 36 and 38 constitute a fixed structure that the latch mechanism 40 is rigidly attached to in a conventional manner.

Figure 7:
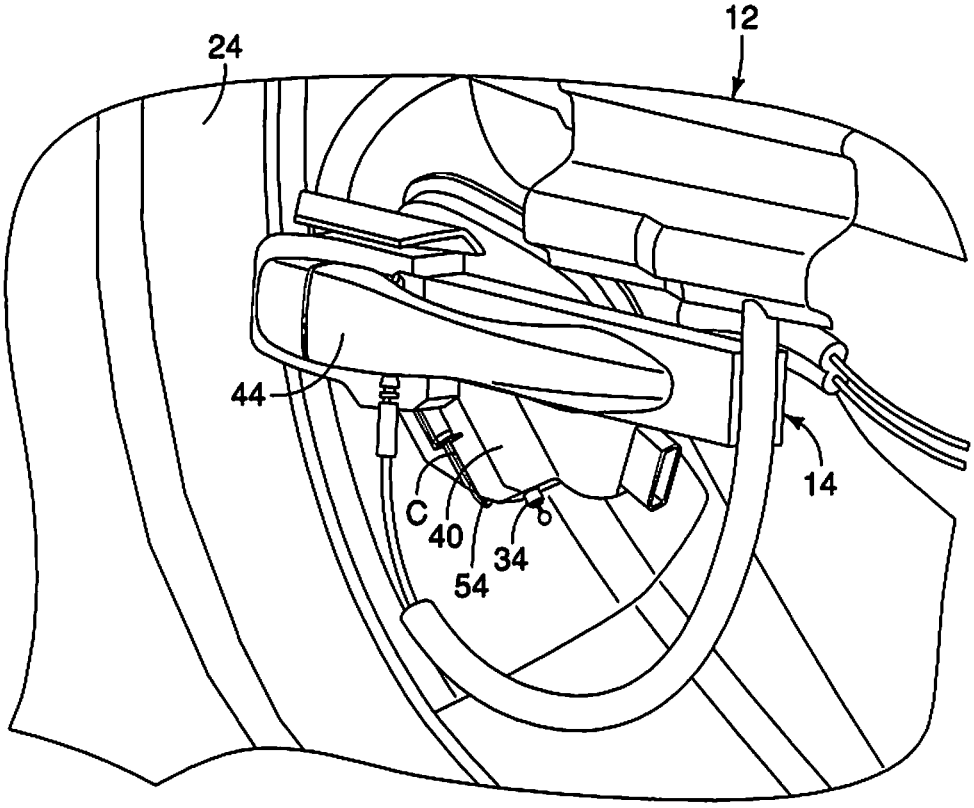
FIG. 7 is a perspective view of a portion of the door showing the latch mechanism with the door in a closed position in accordance with the first embodiment.

As shown in FIGS. 7, 8 and 9, the housing 48 covers and protects at least a portion of the inertia activated lock-out mechanism 34. In FIGS. 10 and 11, an upper portion of a cover of the housing 48 is removed to reveal various internal elements of the latch assembly 40, including the door latch member 50 and the latch retaining member 52. A lower portion of the cover of the housing 48 is removed in FIGS. 12-14 to reveal elements of the inertia activated lock-out mechanism 34, as described in greater detail below.

The door latch member 50 is movably supported to the fixed structure (the housing 48) to pivot between a latched position (FIG. 10) and an unlatched position (FIG. 11). In the latched position, the door latch member 50 is pivoted in a clockwise direction, relative to the depicted view, about its pivot axis so as to surround and clamp onto the striker 46 in a conventional manner, as shown in FIG. 10. In the unlatched position, the door latch member 50 pivots about its pivot axis in a counterclockwise direction relative to FIG. 10, so that the striker 46 is released and the door 12 opens in a conventional manner, as shown in FIGS. 5 and 11.

The door latch member 50 is further biased to move toward the unlatched position by a spring (not shown) that biases the door latch member 50 in a conventional manner. The latch retaining member 52 is a remote actuation part that is supported to the housing 48 (the fixed structure) for pivotal movement about a shaft $S_1$, as shown in FIGS. 10 and 11. The latch retaining member 52 is biased toward the position shown in FIG. 10, where the latch retaining member 52 retains the door latch member 50 in the latched position.

As shown in FIGS. 10 and 11, the release member 54 is preferably made of a hardened metallic material. The release member 54 is movably supported to the housing 48 (the fixed structure) and coupled to the door latch member 50 to move the door latch member 50 from the latched position to the unlatched position. More specifically, release member 54 pivots on a shaft $S_2$ supported on the housing 48. The slave member 56 is fixed to the shaft $S_2$ such that the slave member 56 and the release member 54 rotate as a single body on the shaft $S_2$. In the embodiment depicted in FIGS. 10 and 11, the slave member 56 is located behind the release member 54. However, the exact location of the slave member 56 can be varied depending upon the latch design and door configuration and is not limited to the depicted arrangement.

The link 58 has a first end and a second end. The first end of the link 58 is connected for pivotal movement to the slave member 56. The second end of the link 58 is connected for pivotal movement to the latch retaining member 52. Consequently, when the release member 54 is moved from the latched position (FIG. 10) to the unlatched position (FIG. 11), the slave member 56 pulls on the link 58, which pulls on the latch retaining member 52. This movement in turn causes the latch retaining member 52 to pivot about the shaft $S_1$, releasing the spring biased door latch member 50 so that the vehicle door 12 can open. The slave member 56 and the link 58 essentially constitute a connection portion between the release member 54 and the door latch member 50. Hence, the release member 54 includes a connection portion (the slave member 56 and the link 58) connected to the latch retaining member 52 (the remote actuation part).

Figure 12:
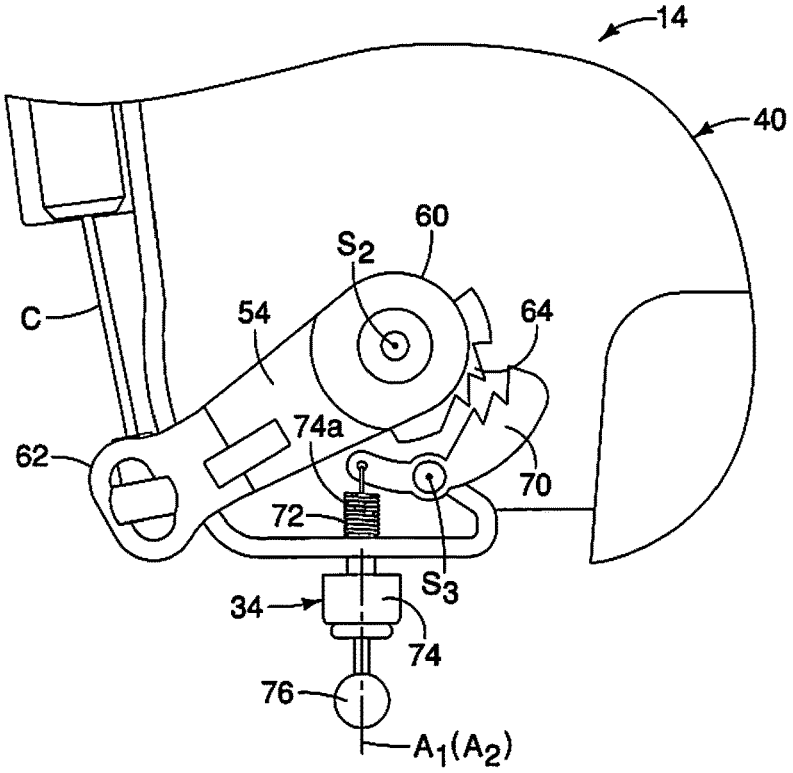
FIG. 12 is a front view of the inertia activated lock-out mechanism showing a release member, a locking member, a biasing spring and a counterweight, with the locking member in a non-interfering position in accordance with the first embodiment.
Figure 13:
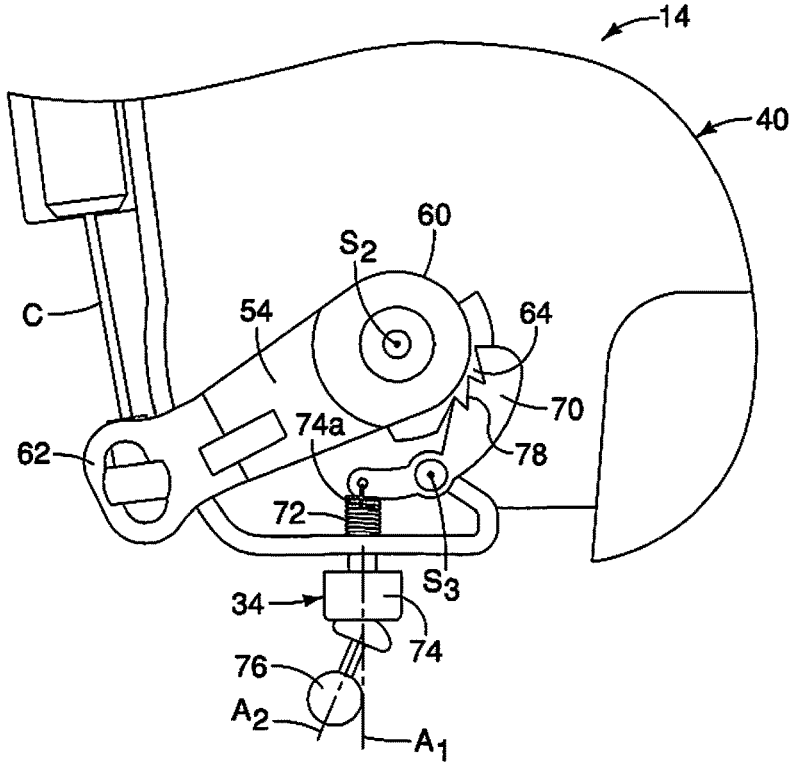
FIG. 13 is another front view of the inertia activated lock-out mechanism showing the release member, the locking member, the biasing spring and the counterweight, with the locking member in a locking position contacting the release member in response to movement of the counterweight in accordance with the first embodiment.

As is shown in FIGS. 12 and 13, the release member 54 includes a first end 60 and a second end 62. The first end 60 is fixed to the shaft $S_2$ for rotation therewith (and for rotating the slave member 56). The second end 62 is connected to a cable C that is coupled to one or both of the inside door release handle 42 and the outside door release handle 44. Hence when either of the inside door release handle 42 or the outside door release handle 44 is operated, the cable C pulls on the release member 54, and the release member 54 pivots to move the door latch member 50 from the latched position (FIG. 10) to the unlatched position (FIG. 11). The first end 60 of the release member 54 also includes a plurality of claw teeth 64. In the depicted embodiment, there are basically three claw teeth 64, as described in greater detail below with a description of the inertia activated lock-out mechanism 34.

Figure 14:
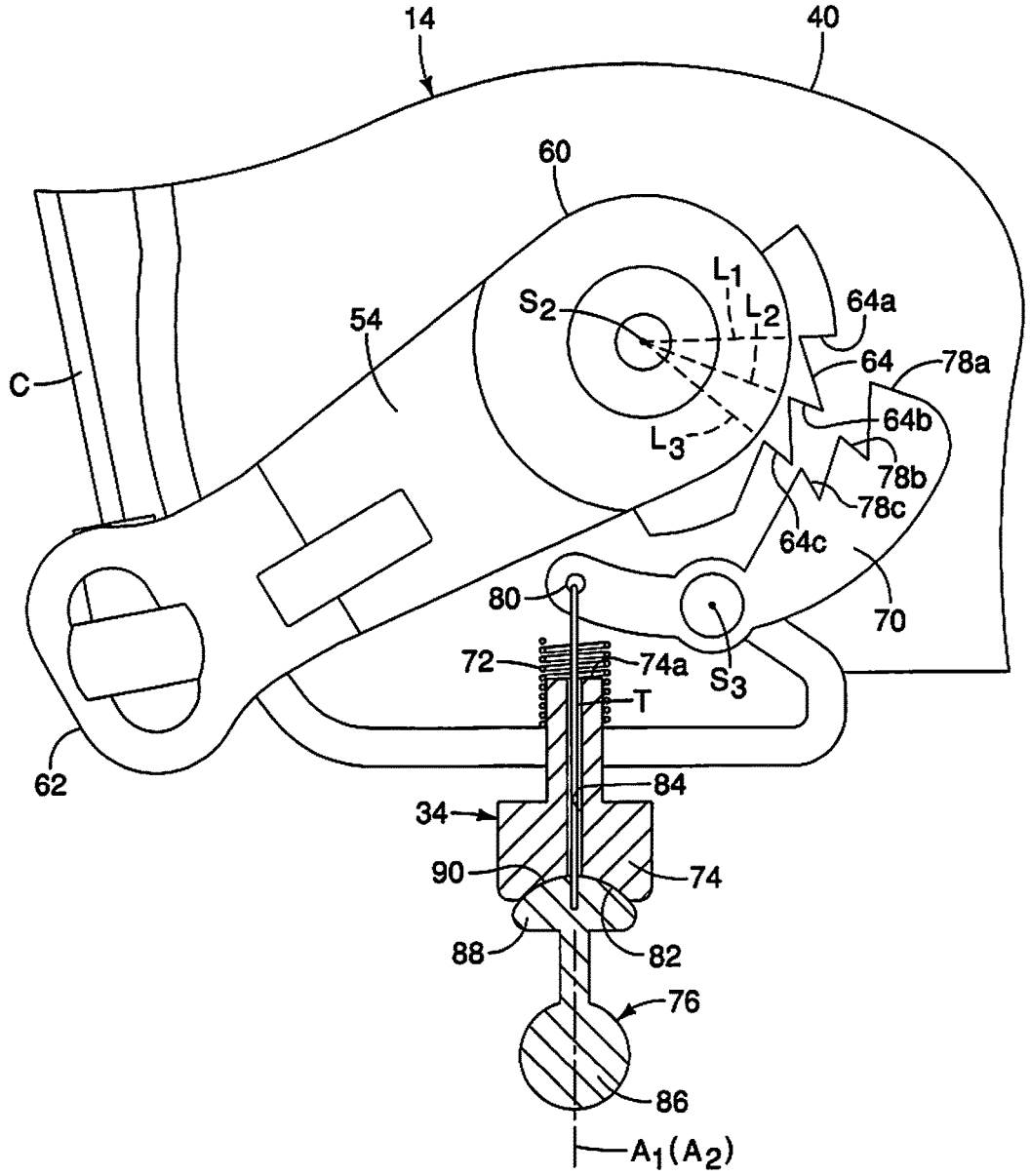
FIG. 14 is a cross-sectional view of the inertia activated lock-out mechanism showing the release member, the locking member, the biasing spring and the counterweight, with the locking member in the non-interfering position in accordance with the first embodiment.

A description of the inertia activated lock-out mechanism 34 is now provided with specific reference to FIGS. 12-14. The inertia activated lock-out mechanism basically includes the release member 54, a locking member 70, a biasing member 72, a base member 74, a counterweight 76 and a tether T. The locking member 70 is mounted on a shaft $S_3$ for pivotal movement. Specifically, the locking member 70 can pivot between a locking position (FIG. 13) that prevents movement of the door latch member 50 from the latched position to the unlatched position, and a non-interfering position (FIGS. 12 and 14) in which the door latch member 50 is free to operate between the latched position and the unlatched position.

The locking member 70 is basically a metallic lever mounted on a shaft $S_3$ for pivoting movement about the shaft $S_3$. The shaft $S_3$ and the shaft $S_2$ and the axes they define are parallel to one another. The locking member 70 is preferably made of a hardened metallic material. The locking member 70 includes a first end that has claw teeth 78 and a tether end 80. The locking member 70 is biased toward the non-interfering position shown in FIGS. 12 and 14 by the biasing member 72. The biasing member 72 is a coil spring that is compressed before installation in the depicted embodiment. Further, the biasing member 72 is tuned to cooperate with the counter weight 76, as described below. The biasing member 72 is a coil spring in the depicted embodiment, but can alternatively be a leaf spring or other type of biasing member so long as the biasing member 72 biases the locking member 70 toward the non-interfering position. In other words, the biasing member 72 is not limited to a coil spring.

As is shown in FIG. 14, the biasing member 72 being a coil spring, defines a hollow central interior with the tether T extending through the hollow central interior of the biasing member 72 (the coil spring).

The claw teeth 78 are dimensioned, sized and positioned such that they can be moved into direct contact with the claw teeth 64 of the release member 54. As shown in FIG. 14, surfaces 64*a*, 64*b* and 64*c* of the claw teeth 64 of the release member 54 extend along respective planes that coincide with the shaft $S_2$. This relationship is demonstrated by lines $L_1$, $L_2$ and $L_3$ which extend through a pivot axis defined by the shaft $S_2$ and align with each of the surfaces 64*a*, 64*b* and 64*c* of the claw teeth 64. Each of the lines $L_1$, $L_2$ and $L_3$ represents a separate plane that coincides with the pivot axis of the release member 54. Surfaces 78*a*, 78*b* and 78*c* are shaped and oriented to mate with the surfaces 64*a*, 64*b* and 64*c*. Each of the surfaces 78*a*, 78*b* and 78*c* of the claw teeth 78 extend along planes (not shown) that extend normal to circles (not shown) centered about the shaft $S_3$. For example, as indicated in FIG. 13, when the locking member 70 is moved to the locking position, the profiles of the claw teeth 64 of the release member 54 match the profiles of the claw teeth 78 of the locking member 70. Any further force applied to either the release member 54 and/or to the locking member 70 draw the claw teeth 78 (and the locking member 70) into closer engagement with the claw teeth 64 and the release member 54. Hence, with the locking member 70 in the locking position (FIG. 13), movement of the release member 54 to the unlatched position (FIG. 11) is prevented. With the locking member 70 moved to the locking position shown in FIG. 13, the claw teeth 64 of the release member 54 engage the claw teeth of the locking member 70 and movement of the release member 54 is prevented. Since the locking member 70 and the release member 54 are made of a hardened metallic material, the locking member 70 and the release member 54 can remain structurally sound even in response to severe impact. Hence the door 12 can be prevented from opening during a sudden impact event, as is further described below.

The base member 74 includes an upper end 74*a* that extends through an aperture in the housing 48. Hence, the upper end 74*a* of the base member 74 is fixedly attached to the housing 48. However, as will be understood from the following description, the base member 74 (and the counterweight 76) can be positioned at any of a variety of locations beside, below or above the housing 48, so long as the counterweight 76 is operatively coupled to the locking member 70 in a manner consistent with the description provided below. As is shown in FIG. 13, when the locking member 70 is moved to the locking position, one end of the locking member 70 can contact the upper end 74*a*. Hence, the upper end 74*a* of the base member 74 is configured to limit overall movement of the locking member 70 defining a hard stop for the locking member 70. When the locking member 70 moves to the locking position, the biasing member 72 is compressed about the upper end 74*a* of the base member 74. The upper end 74*a* is dimensioned to receive the biasing member 72 during compression thereof. The limiting of movement of the locking member 70 serves to protect the biasing member 72 from being over-compressed.

The base member 74 includes a surface 82, a bore 84 that extends completely through the base member 74 from the surface 82 to a distal end thereof adjacent to the biasing member 72. The tether T extends through the bore 84 from the surface 82 to the distal end thereof and through the biasing member 72, as described in greater detail below.

The surface 82 is basically a concave depression having a semi-spherical shaped surface, as indicated in FIG. 14. A portion of the counterweight 76 (described below) together with the surface 82 form a ball and socket relationship such that the counterweight 76 can swivel relative to the surface 82, as described further below.

As best shown in FIG. 14 in cross-section, the surface 82 has a spherical shape or semi-spherical shape (a sphere that has been cut with less that half of the spherical shape remaining). In other words, the surface 82 of the base member 74 is a concave surface relative to the remainder of the base member 74. The bore 84 of the base member 74 is open to a central portion of the surface 82. In other words, the bore 84 (an aperture) is centered relative to the surface 82 and defines a central axis $A_1$ that extends through the concave depression that defines the surface 82. At least a portion of the tether T coincides with the central axis $A_1$. The portion of the tether T that coincides with the central axis $A_1$ is perpendicular to the axes defined by the shafts $S_2$ and $S_3$ with the locking member 70 in the non-interfering position.

As shown in FIG. 14, the counterweight 76 includes mass 86 and a ball end 88 that has a ball shaped surface 90. The mass 86 is spaced apart from the ball end 88 and the surface 90. The ball shaped surface 90 of the ball end 88 of the counterweight 76 is shaped to mate with the surface 82 of the base member 74. The ball end 88 of the counterweight 76 is installed within the concavity of the base member 74 that defines the surface 82. The surface 82 and the ball shaped surface 90 of the counterweight 76 contact one another. The surface 82 and the ball shaped surface 90 can be provided with a Teflon® coating or other friction reducing coating such that the counterweight 76 is free to swivel, pivot and/or otherwise undergo movement relative to the base member 74 with the surface 82 and the surface 90 in contact with one another. However, it should also be understood that the surface 82 and the surface 90 can also be polished and/or otherwise surface treated in such a way as to reduce or eliminate friction therebetween.

As mentioned above, the tether T extends through the bore 84 of the base member 74. One end of the tether T is attached to the tether end 80 of the locking member 70. The other end of the tether T is attached to the ball end 88 of the counterweight 76. As indicated in FIG. 14, the tether T can be embedded within the ball end 88 of the counterweight 76. The tether T can be made of a woven metallic wire, a polymer fiber wire or other flexible material that is bendable, resilient and has a good tensile strength sufficient to retain the counterweight 76 to the locking member 70 for many, many years. More specifically, the tether T is made of a material that resists elongation. In other words, the tether T can bend and elastically deform in a manner consistent with wire or fiber, but is resistant to tensile elongation or deformation that results from being under tension.

The counterweight 76 defines a longitudinal axis $A_2$ that is aligned with the central axis $A_1$ of the base member 74 when the door latch member 70 is in the non-interfering position, as indicated in FIGS. 12 and 14. When mass 86 of the counterweight 76 is moved by rapid changes in inertia, the longitudinal axis $A_2$ can become angularly offset from the central axis $A_1$ of the base member 74. When the counterweight 76 becomes angularly offset from the central axis $A_1$ of the base member 74 by an angle greater than a prescribed minimum angle relative to the central axis $A_1$, the tether T pulls the locking member 70 causing the locking member 70 prevent movement of the release member 54 and consequently preventing movement of the door latch member 50 from the latched position (FIG. 10) to the unlatched position (FIG. 11).

The convex surface 90 of the counterweight 76 and the surface 82 (the concave depression) of the base member 74 define a ball and socket joint such that the counterweight 76 can undergo swiveling movement 360 degrees about the central axis $A_1$ of the base member 74.

As described above, the counterweight 76 is operatively coupled to the locking member 70 via the tether T to move the locking member 70 to the locking position in response to an inertial force exceeding a threshold level being applied to the door latch mechanism 14. More specifically, the mass 86 of the counterweight 76, the spring constant of the biasing member 72 and the distance between the center of gravity of the mass 86 of the counterweight 76 and the surface 82 of the base member 74 are determined in consideration of the threshold level of inertial force necessary to move the counterweight 76, pull the tether T and the locking member 70, thereby preventing the latch assembly 40 from operating to open the door 12.

In an impact event, such as a head-on collision, a side collision, or a roll-over incident, it is advantageous to at least temporarily maintain the doors 12 of the vehicle 10 in a closed position. The inertia activated lock-out mechanism 34, and in particular the counterweight 76, are designed to respond to impact events to prevent the latch assembly 40 from allowing the door 12 to open. Even in a minor impact event, where little or no damage is done to the vehicle 10, the counterweight 76 of the inertia activated lock-out mechanism 34 moves.

If the change in inertia in any direction about the axis $A_1$ reach the level of the threshold level discussed above, the counterweight 76 moves and pulls on the tether T moving the locking member 70 to the locking position (FIG. 13). The door 12 is temporarily prevented from opening. Once movement of the vehicle 10 is such that there are no further changes in inertia acting on the counterweight 76, the counterweight 76 is centered with the axis $A_2$ coinciding with the axis $A_1$ (FIG. 12) due to the force of the biasing member 72. In other words, the biasing member 72 not only biases the locking member 70 to the non-interfering position (FIG. 12), the biasing member 74 also applies a force on the tether T pulling the counterweight 76 into alignment with the axis $A_1$. Hence, after an impact event, the biasing force of the biasing member 74 restores operation of the latch assembly 40 to normal and the door 12 can now be opened.

The threshold level discussed above is dependent upon a variety of variables. For example, the force applied by the biasing member 72 on the locking member 70 and the tether T must be sufficient to restore and maintain the counterweight 76 in a normal, at rest position (FIG. 12) for everyday operation of the vehicle 10. The weight of the mass 86 and the distance of the center of gravity of the mass 86 and the surface 82 are considered with respect to a moment generated relative to the surface 82 in response to rapid changes in inertia in the determination of the threshold level.

It is acceptable for the counterweight 76 to move, for instance, when the door 12 is opened or closed thereby moving the locking member 70 to the locking position, because after a second or two, the biasing member 74 will urge the counterweight back into the at rest position shown in FIG. 12. Thereafter, the door 12 can be opened and closed as desired. In other words, the inertia activated lock-out mechanism 34 can be highly sensitive to even slight changes in inertia without interfering with normal operation of the latch mechanism 40.

Second Embodiment

Figure 15:
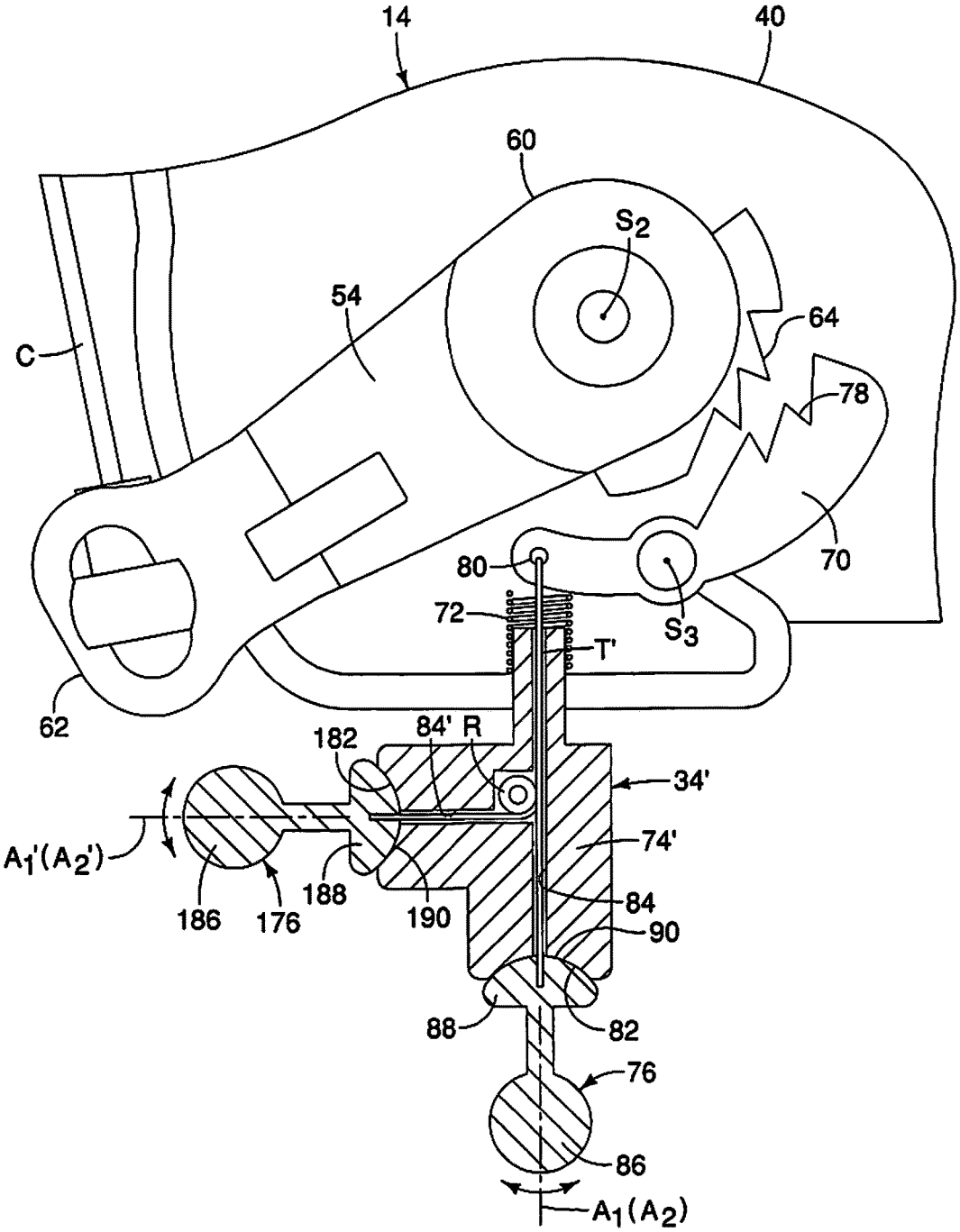
FIG. 15 is a cross-sectional view of an inertia activated lock-out mechanism showing a release member, a locking member, a biasing spring and a counterweight, with the locking member in the non-interfering position in accordance with a second embodiment.

Referring now to FIG. 15, an inertia activated lock-out mechanism 34' in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a single prime (').

The inertia activated lock-out mechanism 34' includes many of the features of the first embodiment, such as the release member 54, the locking member 70 and the biasing member 72. However, in the second embodiment, the base member 74 has been replaced with a base member 74; the tether T has been replaced with a tether T; and a second counterweight 176 has been added.

The base member 74' includes the bore 84 and the surface 82, as in the first embodiment, but also includes a second bore 84' that intersects the bore 84, and a second concave surface 182, as shown in FIG. 15. At the intersection of the bore 84 and the second bore 84', a roller R is provided to ensure smooth movement of the tether T' during impact events. The concave surface 182 is approximately the same as the surface 82, but is oriented perpendicular to the surface 82. In other words, the second bore 84', which is centered relative to the surface 182, is perpendicular to the bore 84.

The second counterweight 176 includes a second mass 186 and a second ball end 188. The second ball end 188 has a ball shaped surface 190. The second counterweight 176 is approximately the same as the counterweight 76 and has basically the same features, except that the second counterweight 176 is oriented perpendicular to the counterweight 76. The second counterweight 176 operates in a manner that is basically the same as the counterweight 76, with the bore 84' and a portion of the tether T' defining an axis $A_1'$, and the counterweight 176 defining a second axis $A_2'$. When the counterweight 176 is in an at rest position as shown in FIG. 15, the axis $A_1'$ and the second axis $A_2'$ coincide. However, in response to rapid changes in inertia, the counterweight 176 will move such that the second axis $A_2'$ is angularly offset from the axis $A_1'$ causing the counterweight 176 to pull on the tether T' moving the locking member 74 from the non-interfering position to the locking position.

The use of both the counterweight 76 and the counterweight 176 increases the sensitivity of the inertia activated lock-out mechanism 34' as compared to the inertia activated lock-out mechanism 34 of the first embodiment. More specifically, rapid changes in inertia resulting from impact events from just about any possible angle relative to the vehicle 10 can be detected and the doors 12 prevented from opening until after the conclusion of the impact event.

There are various elements and components of the vehicle 10 that are conventional components well known in the art. Since such elements and components are well known in the art, these structures will not be discussed or illustrated in detail herein. Rather, it will be apparent to those skilled in the art from this disclosure that the components can be any type of structure and/or programming that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "forward", "rearward", "above", "downward", "vertical", "horizontal", "below" and "transverse" as well as any other similar directional terms refer to those directions of a vehicle equipped with the vehicle door latch mechanism. Accordingly, these terms, as utilized to describe the present invention should be interpreted relative to a vehicle equipped with the vehicle door latch mechanism.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A vehicle door latch mechanism comprising:

a latch assembly including a housing, a door latch member, a latch retaining member and a release member, the door latch member being movably supported within the housing to pivot about a first pivot axis between a latched position and an unlatched position, the latch retaining member being movably supported within the housing to pivot between a retaining position retaining the door latch member in the latched position and a releasing position, the release member being supported within the housing for pivotal movement about a second pivot axis spaced apart from the first pivot axis and having a first end connected to a cable of a remote actuation part and a second end located within the housing operatively coupled to the latch retaining member, the release member moving in response to movement of the cable; and an inertia activated lock-out mechanism including a locking member disposed within the housing and being pivotally supported by the housing for movement about a third pivot axis spaced apart from the first pivot axis and the second pivot axis, the first pivot axis, the second pivot axis and the third pivot axis all being parallel to one another at fixed locations within the housing, the locking member pivoting between a locking position in which the locking member contacts the release member to prevent movement of the release member independent of movement of the cable of the remote actuation part and a non-interfering position in which the locking member is spaced apart from the release member allowing the release member to be movable, and the inertia activated lock-out mechanism further including a counterweight operatively coupled to the locking member to move the locking member to the locking position in response to an inertial three exceeding a threshold level.

2. The vehicle door latch mechanism according to claim 1, wherein the locking member includes first claw teeth and the release member includes second claw teeth, the first and second claw teeth being engaged with one another with the locking member in the locking position.

3. The vehicle door latch mechanism according to claim 2, wherein the counterweight is a tethered ball counterweight.

4. The vehicle door latch mechanism according to claim l, wherein the counterweight is a tethered ball counterweight.

5. The vehicle door latch mechanism according to claim I, wherein the latch retaining member pivots about a fourth pivot axis positioned at a fixed location within the housing, the fourth pivot axis being parallel to each of the first, second and third pivot axes.

6. The vehicle door latch mechanism according to claim 1, wherein the inertia activated lock-out mechanism includes a biasing member that biases the locking member toward the non-interfering position.

7. The vehicle door latch mechanism according to claim 6, wherein the biasing member of the inertia activated lock-out mechanism extends in a direction perpendicular to each of the first, second and third pivot axis.

8. The vehicle door latch mechanism according to claim 6, wherein the biasing member is a coil spring defining a hollow central interior, with a tether extending through the hollow central interior within the coil spring, the tether being attached to the counterweight.

9. The vehicle door latch mechanism according to claim 1, wherein the inertia activated lock-out mechanism includes a base member defining a concave depression and the counterweight includes a convex surface portion disposed within the concave depression.

10. The vehicle door latch mechanism according to claim 9, wherein the base member defines a central axis that extends through the concave depression, the counterweight defines a longitudinal axis that is aligned with the central axis of the base member when the door latch member is in the non-interfering position, and when the counterweight is moved such that the longitudinal axis is angularly offset from the central axis of the base member by an angle greater than a prescribed minimum angle relative to the central axis, movement of the door latch member from the latched, position to the unlatched position is prevented.

11. The vehicle door latch mechanism according to claim 10, wherein the convex surface portion of the counterweight and the concave depression of the base member define a ball and socket joint such that the counterweight can undergo swiveling movement 360 degrees about the central axis.

12. The vehicle door latch mechanism according to claim 9, wherein the concave depression of the base member has a semi-spherical shape, and the convex surface portion of the counterweight has a semi-spherical shape that corresponds to the semi-spherical shape of the concave depression of the base member.

13. The vehicle door latch mechanism according to claim 1, wherein the counterweight is connected to the locking member by a tether, the tether defining an axis that extends between the counterweight and the locking member, the inertial force exceeding the threshold level that causes the counterweight to move being applied in any direction normal to the axis defined by the tether.

14. The vehicle door latch mechanism according to claim 1, wherein the inertia activated lock-out mechanism includes a biasing member and a base member, the biasing member biasing the locking member away from the locking position and the base member defining a hard stop configured to limit overall movement of the locking member beyond the locking position.

* * * * *